252-95 AU 166 EX
6/9/81 XR 4,272,396

United States Patent [19]

Fukano et al.

[11] 4,272,396

[45] Jun. 9, 1981

[54] ENZYME-CONTAINING DETERGENT COMPOSITION

[75] Inventors: Kazuaki Fukano, Chiba; Ryuichi Nakagawa, Narashino; Akira Fukasawa, Yachiyo; Hiroshi Nishio, Chiba, all of Japan

[73] Assignee: The Lion Fat & Oil Co., Ltd., Tokyo, Japan

[21] Appl. No.: 96,158

[22] Filed: Nov. 20, 1979

[30] Foreign Application Priority Data

Dec. 5, 1978 [JP] Japan ..... 53/150297

[51] Int. Cl.[3] ..... C11D 3/386; C11D 7/42

[52] U.S. Cl. ..... 252/174.12; 252/95; 252/DIG. 12; 252/555; 252/556

[58] Field of Search ..... 252/174.12, 95, 555, 252/556, DIG. 12

[56] References Cited

U.S. PATENT DOCUMENTS

| | | | |
|---|---|---|---|
| 3,600,318 | 8/1971 | Mast | 252/174.12 X |
| 3,607,653 | 9/1971 | Ziffler | 252/174.12 X |
| 3,676,374 | 7/1972 | Laki et al. | 252/555 X |
| 3,998,762 | 12/1976 | Murata et al. | 252/555 X |
| 4,028,283 | 6/1977 | Murata et al. | 252/555 X |

*Primary Examiner*—Mayer Weinblatt
*Attorney, Agent, or Firm*—Armstrong, Nikaido, Marmelstein & Kubovcik

[57] ABSTRACT

Enzyme-containing detergent compositions containing, as essential ingredients, α-olefin sulfonates having 10 to 20 carbon atoms, polyethylene glycols having a weight-average molecular weight of 1,000 to 20,000 and enzymes are presented. These enzyme-containing detergent compositions do not cause the decrease in foaming property when objects being washed are previously soaked in an aqueous solution of the enzyme-containing detergent composition.

9 Claims, No Drawings

ENZYME-CONTAINING DETERGENT COMPOSITION

The present invention relates to enzyme-containing detergent compositions. More specifically, it relates to enzyme-containing detergent compositions capable of retaining the good foaming property of detergent compounds even in the case where materials to be washed are soaked in a detergent solution.

The addition of enzymes into detergent compositions is known in the art. Enzyme-containing detergent compositions are disclosed, for example, in U.S. Pat. Nos. 3,600,318 and 3,676,374. Enzymes contained in enzyme-containing detergent compositions act as an auxiliary agent to increase detergency. For instance, in the case of laundry detergents, enzymes degrade various soil or stains which are adhere to fabrics or otherwise change the properties of the same. In the case of dish washing detergents, enzymes degrade various fats and oils, proteins, starches and the like which are adhered to the surfaces of dishes and the like or otherwise change the properties of the same. Thus, enzymes render these soil more easily removed by the detergent compounds.

In order to fully exhibit the above-mentioned functions of the enzymes, it is preferable that materials to be washed are soaked, for a long time, for example, for 1 hour or through 1 night or 1 day, in a wash liquor (i.e. an aqueous solution of enzyme-containing detergent compositions). As a result, the detergency of the detergent compositions are remarkably improved. However, conventional enzyme-containing detergent compositions have a disadvantage in that the foaming property of an aqueous solution of the conventional enzyme-containing detergent compositions are remarkably impaired by the soaking of the materials to be washed therein. It appears to us that the decrease of the foaming power is caused by the action of the enzymes contained in the detergent composition. That is to say, when materials to be washed are soaked in an aqueous solution of the conventional enzyme-containing detergent compositions, the enzymes not only attack the soil on the materials to be washed, but also attack the surface active agents present in the detergent composition to thereby decrease the foaming power.

The decrease in the foaming power of enzyme-containing detergent compositions per se does not remarkably affect the detergency of the detergent composition. However, since consumers generally like to judge the quality of detergents based upon the foaming power thereof, the value of the enzyme-containing detergent compositions, as a commercial product, is impaired by the decrease in the foaming of the aqueous solution of the enzyme-containing detergent compositions, said decrease being due to the soaking of the materials to be washed for a relatively long time.

Accordingly, the objects of the present invention are to obviate the aforementioned disadvantage of the conventional enzyme-containing detergents compositions and to provide enzyme-containing detergent compositions which are capable of retaining a good foaming power of detergent compounds even in the case where materials to be washed are dipped in an aqueous solution of the enzyme-containing detergent compositions.

Other objects and advantages of the present invention will be apparent from the description set forth hereinbelow.

In accordance with the present invention, there is provided an enzyme-containing detergent composition comprising an anionic surface active agent containing, as a main constituent, at least one α-olefin sulfonate having 10 to 20 carbon atoms, polyethylene glycol having a weight-average molecular weight of 1,000 to 20,000 and at least one enzyme, the content of said anionic surface active agent in the composition being 5 to 40% by weight and the content of said polyethylene glycol in the composition being 0.1 to 10% by weight.

The enzymes added into the detergent composition of the present invention are those which have an activity under the conditions of pH of approximately 4 to 13, more preferably, of approximately 7 to 10.5 and a temperature of approximately 10° to 80° C., more preferably, of approximately 20° to 60° C. For instance, proteolytic enzymes (proteases), amylases and lipases may be used in the present invention so long as the above-mentioned requirements are fulfilled. Among those enzymes, proteolytic enzymes derived from bacteria such as Bacillous Subtilis are preferred. Specific example of proteolytic enzymes suitable for use in the present invention are Alcalase (manufactured by Novo Industri A/S, Denmark), Maxatase (manufactured by Gist Brocades N.V, Holland) and the like.

Enzymes, in the form of powder or granule, which is adhered onto a carrier, for example, sodium sulfate, sodium chloride or nonionic surfactants, may be usually added into the detergent composition.

In the case where amylase is added into the detergent composition according to the present invention, amylase is preferably used in such an amount that the resultant detergent composition has an enzyme activity of $10^4$ to $10^6$ Maltose unit per 1 kg of the resultant detergent composition. In the case where a proteolytic enzyme is incorporated into the detergent composition according to the present invention, the proteolytic enzyme is preferably used in such an amount that the resultant detergent composition has an enzyme activity of 1 to 20 Anson unit per 1 kg of the resultant detergent cofnposition.

The enzyme-containing detergent compositions according to the present invention contain 5 to 40% by weight of an anionic surface active agent or agents, at least 50% by weight of which agents should be α-olefin sulfonate having 10 to 20 carbon atoms. If the amount of the α-olefin sulfonate in the anionic surfactants is less than 50% by weight, the foaming property of an aqueous solution of the enzyme-containing detergent composition is impaired when materials being washed are soaked therein.

The α-olefin sulfonates used in the present invention includes those which can be prepared in any conventional manner. For instance, α-olefins (including vinylidene type olefin) having 10 to 20 carbon atoms, which are prepared by wax cracking processes, ethylene oligomerization processes utilizing Ziegler catalysts or improved processes thereof, are first sulfonated by gaseous sulfur trioxide diluted with an inert gas, and the sulfonated products are then neutralized with, for example, alkali metal hydroxides followed by being hydrolyzed. Thus, α-olefin sulfonates are prepared.

Typical examples of α-olefin sulfonates are alkali metals (e.g. Na, K), alkaline earth metals (e.g. Ca, Mg) and ammonium and alkanol amine salts, of 1-tetradecene sulfonate, 1-hexadecene sulfonate, 1-octadecene sulfonate and the like.

Anionic surface active agents other than α-olefin sulfonates, which can be used together with α-olefin sulfonates in the present invention include, for example, linear alkylbenzene sulfonates having $C_{10}$ to $C_{18}$ alkyl groups; alkyl sulfates having 8 to 16 carbon atoms; polyoxyethylene alkyl ether sulfates which are prepared by sulfating and neutralizing ethoxylates derived from the addition products of higher alcohols having 9 to 15 carbon atoms with 1 to 10 mol, based upon 1 mol of the higher alcohols, of ethylene oxide; alkane sulfonates derived from paraffins having 12 to 22 carbon atoms; soaps having 10 to 18 carbon atoms. These anionic surfactants can be used alone or any combination thereof. These anionic surface active agents can be in the form of alkali metal salts (e.g., Na, K), ammonium salts, alkanol amine salts or alkaline earth metal salts (e.g., Ca, Mg).

Polyethylene glycols incorporated into the enzyme-containing detergent composition of the present invention are those which have a weight-average molecular weight of 1,000 to 20,000 and, preferably, of 1,500 to 10,000. If the weight-average molecular weight of the polyethylene glycol is less than 1000, sufficient foaming stability cannot be obtained in the enzyme-containing detergent composition. On the other hand, if the weight-average molecular weight of the polyethylene glycol is more than 20,000, the foaming of detergent solution becomes worse even before materials to be washed are soaked. The amount of the polyethylene glycol incorporated into the enzyme-containing detergent composition of the present invention is within the range of from 0.1 to 10% by weight. If the amount of the polyethylene glycol is less than 0.1% by weight, sufficient foaming stability or power cannot be obtained in the enzyme-containing detergent composition. On the other hand, if the amount of polyethylene glycol is more than 10% by weight, the foaming of an aqueous solution of the detergent composition becomes worse even before materials being washed are soaked in the washing solution.

As mentioned hereinabove, the enzyme-containing detergent composition of the present invention contains, as essential constituents, the anionic surface active agents mainly consisting of the α-olefin sulfonates, the polyethylene glycols and the enzymes. However, some other conventional detergent ingredient can be optionally incorporated into the enzyme-containing detergent composition of the present invention so long as the above-mentioned requirements are fulfilled. These optional ingredients, especially builders, are usually incorporated into the enzyme-containing detergent composition in an amount of less than 50% by weight, based upon the total amount of the detergent composition.

Examples of such optional ingredients are nonionic surface active agents such as polyoxyethylene alkyl ethers, polyoxyethylene alkylphenol ethers, polyoxyethylene fatty acid esters, sorbitan fatty acid ester polyoxyethylene ethers, sucrose fatty acid esters, fatty acid alkylolamides and the like; ampholytic surface active agents such as betain type (e.g. lauryl dimethylcarboxymethyl ammonium betain), alanine type imidazoline type and the like; organic builders such as citrates, malates, tartrates, salts of the polymers of maleic acid, alkyl-substituted succinates, oxydiacetates and the like; inorganic builders such as water-soluble sulfates, water-soluble phosphates, water-soluble carbonates, water-soluble silicates, aluminosilicates (zeolite); redeposition preventing agents such as carboxymethyl cellulose (CMC), polyvinyl alcohol (PVA) and the like; suds control agents such as soap and the like; optical brightening agents; bleaching agents; coloring agents; pigments and the like.

The enzyme-containing detergent composition of the present invention can be in the form of powder, particles or liquid. However, we prefer to use the enzyme-containing detergent composition in the powder or particle form since the activity of the enzymes in the detergent composition remains substantially constant during a relatively long storage period of the product. The preparation of the enzyme-containing detergent composition of the present invention can be carried out in any conventional manner known in the art.

The reason that the decrease in the foaming of an aqueous solution of conventional enzyme-containing detergent composition, after materials being washed are soaked therein, can be substantially obviated by the use, in combination, of the α-olefin sulfonates and the polyethylene glycols is by no means completely understood. However, it is believed that the unique effects of the present invention are due to the facts that the α-olefin sulfonates are not so susceptible to the action of the enzymes as other anionic surface active agents and that the α-olefin sulfonates, the enzymes and a composite mixture of the α-olefin sulfonates and the enzymes are predominantly adsorbed on the interface between the gas and the liquid by the polyethylene glycols.

The present invention now will be further illustrated by, but is by no means limited to, the following Examples.

EXAMPLE 1

The foaming property of the various laundry detergent compositions each having the composition listed in Table 1 below were tested in the following manner.

[Foaming Test Method 1]

Undershirts (cloth woven from a cotton yarn) which were worn for 2 days were symmetrically cut in half and divided into two groups. One group was washed after being soaked in a detergent solution. The other group was washed without the soaking. The soaking conditions were as follows.

| | |
|---|---|
| Concentration of Detergent Composition | 0.8 wt % |
| Liquid Temperature | 25° C. |
| Bath Ratio* | 5 |
| Soaking Time | 8 hours |

*A ratio of the washing liquid volume to the shirt weight.

The undershirts were washed in a impeller type washer (PS-5200 AOZORA, Hitachi Seisakusho) for 10 minutes under the conditions of a detergent concentration of 0.14% by weight, a liquid temperature of 25° C. and a bath ratio of 30. After washing, the formed foam were uniformly distributed on the entire surface of the wash liquor and, then, the height of the foam was measured. The results are shown in Table 1 below.

TABLE 1

| | Run No. | | | | | | | | | |
|---|---|---|---|---|---|---|---|---|---|---|
| | 1 | 2 | 3 | 4(8) | 5(8) | 6(8) | 7 | 8 | 9 | 10(8) |
| AOS(1) (wt%) | 25 | 20 | 15 | 10 | 10 | — | — | 15 | 15 | 15 |

TABLE 1-continued

| | Run No. | | | | | | | | | |
|---|---|---|---|---|---|---|---|---|---|---|
| | 1 | 2 | 3 | 4[8] | 5[8] | 6[8] | 7 | 8 | 9 | 10[8] |
| LAS[2] (wt%) | — | 5 | 10 | 15 | — | 25 | 25 | 5 | 5 | 5 |
| AS[3] (wt%) | — | — | — | — | 15 | — | — | — | — | — |
| AES[4] (wt%) | — | 1 | 1 | 1 | 1 | 1 | 1 | — | — | — |
| Soap[5] (wt%) | 2 | 2 | 2 | 2 | 2 | 2 | 2 | 2 | 2 | 2 |
| Sodium tripoly-phosphate (wt%) | — | — | — | — | — | — | — | 18 | 18 | 18 |
| Sodium pyro-phosphate (wt%) | 20 | 20 | 20 | 20 | 20 | 20 | 20 | — | — | — |
| Sodium silicate (wt%) | 10 | 10 | 10 | 10 | 10 | 10 | 10 | 15 | 15 | 15 |
| Sodium Carbonate (wt%) | 6 | 6 | 6 | 6 | 6 | 6 | 6 | 5 | 5 | 5 |
| Enzyme[6] (wt%) | 1 | 1 | 1 | 1 | 1 | 1 | — | 0.5 | 0.5 | 0.5 |
| PEG[7] (wt%) | 2 | 2 | 2 | 2 | 2 | 2 | 2 | 2 | 1 | 0 |
| Water (wt%) | 10 | 10 | 10 | 10 | 10 | 10 | 10 | 10 | 10 | 10 |
| Sodium Sulfate | balance | balance | balance | balance | balance | balance | balance | balance | balance | balance |
| Foam Height (no soaking, mm) | 34 | 27 | 25 | 24 | 25 | 34 | 33 | 25 | 26 | 28 |
| Foaming Ratio (soaking/No soaking) | 0.9 | 0.9 | 0.9 | 0.7 | 0.6 | 0.2 | 1.0 | 1.0 | 0.9 | 0.6 |

[1]AOS: Sodium $C_{14}$-$C_{16}$ α-olefin sulfonate
[2]LAS: Sodium linear alkylbenzene sulfonate ($C_{12}$-$C_{13}$ alkyl)
[3]AS: Sodium alkyl sulfate ($C_{12}$-$C_{14}$ alkyl)
[4]AES: Sodium polyoxyethylene alkylether sulfate ($C_{12}$-$C_{15}$ alkyl, EO $\bar{P}$ = 3)
[5]Soap: Tallow soap
[6]Enzyme: Protease (Granular Enzyme Alcalase 1.5 M, Novo Industri A/S)
[7]PEG: Polyethylene glycol $\overline{Mw}$ = 4000
[8]Run Nos. 4, 5, 6 and 10 are Comparative Examples.

As is clear from the results shown in Table 1, the detergent compositions of Run Nos. 1 to 3 and 7 to 9 according to the present invention have excellent foaming ratios of 0.9 to 1.0, whereas the detergent compositions of Run Nos. 4 to 6 and 10 have poor foaming properties after the shirts were soaked in the detergent compositions.

EXAMPLE 2

Foaming tests of the detergent compositions of Example 1 were repeated by using the detergent compositions containing various polyethylene glycols having different weight-average molecular weights, listed in Table 2 below. The other ingredients incorporated into the detergent composition are the same as those in Example 1.

| Composition | % by weight |
|---|---|
| AOS | 15 |
| LAS | 5 |
| Sodium pyrophosphate | 15 |
| Sodium silicate | 15 |
| Enzyme | 0.3 |
| PEG | 2 |
| Water | 10 |
| Sodium sulfate | Balance |

TABLE 2

| Weight-Average Molecular Weight of PEG | 600 | 1000 | 6000 | 20,000 |
|---|---|---|---|---|
| Foaming (no soaking, mm) | 16 | 20 | 25 | 22 |
| Foaming Ratio (Soaking/No Soaking) | 0.7 | 0.9 | 1.0 | 0.9 |

EXAMPLE 3

Liquid heavy-duty detergent compositions for textile material or fabrics having the composition shown in Table 3 below were prepared. The foaming properties of the detergent composition thus prepared were tested in a manner as described in Example 1. The results are shown in Table 3 below.

TABLE 3

| | No. | |
|---|---|---|
| | 11 | 12 |
| LAS[1] (wt%) | — | 20 |
| AOS[2] (wt%) | 20 | — |
| AE[3] (wt%) | 25 | 25 |
| PEG[4] (wt%) | 2 | 2 |
| Ethanol (wt%) | 8 | 8 |
| Enzyme[5] (wt%) | 2 | 2 |
| Water | Balance | Balance |
| Foaming (no soaking, mm) | 40 | 30 |
| Foaming Ratio (Soaking/No Soaking) | 0.9 | 0.6 |

[1]LAS: Sodium linear alkylbenzene sulfonate ($C_{12}$-$C_{13}$ alkyl)
[2]AOS: Sodium α-olefin sulfonate ($C_{14}/C_{16}$ = 5/5)
[3]AE: Alcohol ethoxylate ($C_9$-$C_{11}$ alkyl, EO $\bar{P}$ = 8)
[4]PEG: Polyethylene glycol, $\overline{MW}$ = 2000
[5]Enzyme, Savinase (Novo Industri A/S)

EXAMPLE 4

Dish washing liquid detergent compositions Nos. 13 and 14 having the compositions shown in Table 4 below were prepared.

TABLE 4

| | No. 13 | No. 14 |
|---|---|---|
| LAS[1] (wt%) | 5 | 15 |
| AOS[2] (wt%) | 15 | — |
| AS[3] (wt%) | 5 | — |
| AES[4] (wt%) | — | 10 |
| Urea (wt%) | 13 | 13 |
| Ethanol (wt%) | 5 | 5 |
| Enzyme[5] (wt%) | 2 | 2 |
| PEG[6] (wt%) | 2 | 2 |
| Water | Balance | Balance |

[1]See Example 1
[2]AOS: Sodium α-olefin sulfonate ($C_{14}/C_{16}$ = 7/3)
[3][4]See Example 1
[5]Amylase, Biotex 3N (Nagase Biochemicals, Ltd.)
[6]See Example 3

Liquid detergent compositions Nos. 13A and 14A having the same compositions as the composition Nos.

13 and 14, respectively, were prepared, except that the enzymes were not incorporated into the compositions. The foaming ratios of the compositions No. 13A/No. 13 and No. 14A/No. 14 were measured in the following manner.

[Foaming Test Method 2]

To a vat having a diameter of 30 cm and a height of 12 cm, 3 liters of a washing liquor having a detergent concentration of 0.15% and a temperature of 25° C. are charged. In this washing liquor, dishes contaminated with butter (0.5 g/dish) are soaked for 8 hours and, then, the front surfaces of the contaminated dishes are rubbed or washed five times with a sponge and the back surfaces thereof are rubbed or washed three times with a sponge.

A count is kept of the number of dishes washed and, when foam height of the detergent solution becomes 1 mm, this is defined as representing a foaming power. Thus, the foaming ratios of the enzyme-containing detergent compositions to the non-enzyme containing detergent compositions are represented by the ratios of the number of dishes washed in the enzyme-containing detergent compositions to the number of dishes washed in the non-enzyme containing detergent compositions. The results are shown in Table 5 below.

TABLE 5

| | No. 13A/No. 13 | No. 14A/No. 14 |
|---|---|---|
| Foaming ratio (Enzyme/No enzyme) | 0.9 | 0.5 |

What we claim is:

1. An enzyme-containing detergent composition consisting essentially of:

an enzyme having an activity under the conditions of a pH of about 4 to about 13, and a temperature of about 10° to about 80° C.;

an anionic surface active agent containing at least 50% by weight of α-olefin sulfonate having 10 to 20 carbon atoms, said anionic surface active agent being contained within said composition in an amount of 5 to 40% by weight, and;

polyethylene glycol having a weight average molecular weight of 1,000 to 20,000, said polyethylene glycol being contained within said composition in an amount of 0.1 to 10% by weight.

2. An enzyme-containing detergent composition as claimed in claim 1, wherein the weight-average molecular weight of the polyethylene glycol is within the range of from 1,500 to 10,000.

3. An enzyme-containing detergent composition as claimed in claim 1, wherein said enzyme is included in amount such that the resultant detergent composition has an enzyme activity of 1 to 20 Anson Unit per 1 Kg of the resultant detergent composition.

4. An enzyme-containing detergent composition as claimed in claim 1, wherein said detergent composition is in the form of powder or granule.

5. An enzyme-containing detergent composition as claimed in claim 1, wherein said composition further contains not more than 50% by weight of conventional detergent ingredients.

6. An enzyme-containing detergent composition as claimed in claim 1, wherein said enzyme is active at a pH of 7 to 10.5.

7. An enzyme-containing detergent composition as claimed in claim 1, wherein said enzyme is active at a temperature of 20° to 60° C.

8. An enzyme-containing detergent composition as claimed in claim 1, wherein said enzyme is selected from the group consisting of proteolytic enzymes, amylases and lipases.

9. An enzyme-containing detergent composition as claimed in claim 8, wherein said enzyme is a proteolytic enzyme derived from bacteria.

* * * * *